US006189540B1

(12) United States Patent
Stovall et al.

(10) Patent No.: US 6,189,540 B1
(45) Date of Patent: Feb. 20, 2001

(54) HAIR STYLING COMB

(75) Inventors: Denise L. Stovall, 2717 Silverdale La., Garland, TX (US) 75044; Marianne T. Morehead, 3702 Dartmouth, Dallas, TX (US) 75202; Clifford T. Calfee, Richardson, TX (US)

(73) Assignees: Denise L. Stovall, Garland; Marianne T. Morehead, Dallas, both of TX (US)

( * ) Notice: Under 35 U.S.C. 154(b), the term of this patent shall be extended for 0 days.

(21) Appl. No.: 09/138,481

(22) Filed: Aug. 21, 1998

(51) Int. Cl.[7] ..... A45D 24/04; A45D 24/00

(52) U.S. Cl. ..... 132/139; 132/219; 132/162; 132/163

(58) Field of Search ..... 132/139, 219, 132/162, 163

(56) References Cited

U.S. PATENT DOCUMENTS

| | | | | |
|---|---|---|---|---|
| 1,672,469 | * | 6/1928 | Oshman et al. | 132/219 |
| 2,646,804 | * | 7/1953 | Newman | 132/163 |
| 2,792,007 | * | 5/1957 | Parmer | 132/162 |
| 3,595,248 | * | 7/1971 | Wright | 132/162 |
| 3,628,545 | * | 12/1971 | Moody | 132/162 |
| 3,867,502 | * | 2/1975 | Moody | 132/163 |
| 4,263,691 | * | 4/1981 | Pakarnseree | 15/159 |
| 5,018,542 | * | 5/1991 | Lee | 132/139 |
| 5,524,575 | * | 6/1996 | Lennon | 119/83 |

* cited by examiner

*Primary Examiner*—John J. Wilson
*Assistant Examiner*—Robyn Kieu Doan
(74) *Attorney, Agent, or Firm*—Akin, Gump, Strauss, Hauer & Feld, L.L.P.

(57) ABSTRACT

A hair styling comb includes a molded plastic or metal core member including a body part having first and second sets of integrally formed spaced apart comb teeth extending in directions substantially normal to each other. The first set of teeth extends from an elongated spine part of the body and a layer of a resilient friction material is molded over the body part to cover opposed planar surfaces of the body part and to extend within spaces between adjacent teeth of both sets. The overmolded layer provides surfaces between each tooth which are adherent to human hair to facilitate teasing, back combing or ratting hair during a styling procedure. The comb is conveniently mass produceable by molding the core member and then overmolding the resilient high friction coating or material layer.

5 Claims, 4 Drawing Sheets

HAIR STYLING COMB

FIELD OF THE INVENTION

The present invention pertains to a hair styling comb including a layer of resilient material adherent to hair molded over a core member and between the comb teeth to improve handling and hair teasing or back combing.

BACKGROUND

Hair teasing, back combing or ratting is a widely used hair styling process. A long standing problem in efficient and effective teasing or back combing of hair pertains to use of a comb which easily trains the hair in a conventional matter but is also capable of adequately frictionally engaging the forward ends of a layer of hair to grip and tease the hair. In this regard it has been determined that the root, valley or base portions between the comb teeth should present surfaces that adhere to the hair strands that are being teased to maximize the effectiveness of the teasing operation.

Still further, there has been a desire and need to develop a comb which may be easily gripped during combing and teasing operations without slipping from the operator's hands. Providing a comb which may be easily and firmly gripped is particularly required during a teasing operation when the comb tends to snag or undergo greater drag when being drawn through a person's hair. Still further, it is desirable to provide a comb which is aesthetically pleasing and has a friction surface formed thereon to minimize sliding of the comb when it is placed on a horizontal surface such as a vanity or counter.

The shortcomings of prior art hair styling or teasing combs and the desired features mentioned above for a hair styling or teasing comb have been overcome and provided in a comb in accordance with the present invention.

SUMMARY OF THE INVENTION

The present invention pertains to an improved comb, particularly a comb adapted for hair styling operations, including teasing or ratting hair.

In accordance with one aspect of the present invention a hair styling comb is provided which includes a core member comprising an integral body portion, a handle portion and a set of spaced apart combing teeth and teasing teeth all integrally formed. The comb may also include a set of hair lifting and stroking teeth integrally formed with the body portion and projecting substantially normal to the set of combing and styling or teasing teeth.

A comb in accordance with the present invention is advantageously configured to have a core member with hair styling teeth (combing, teasing and lifting teeth) molded integral therewith and a coating or layer of resilient material molded over the core member and extending into spaces between the teeth to provide a friction surface for engagement with the hair strands to provide for teasing or ratting hair. The continuous overmolded layer or coating conveniently provides the high friction surfaces between the comb teeth and also provides a large area of the comb body which may be easily and firmly grasped during use of the comb. Moreover, the comb is also less likely to slide off of a low friction surface when placed thereon when not in use.

Those skilled in the art will further appreciate the above mentioned features and advantages of the invention together with other important aspects thereof upon reading the detailed description which follows in conjunction with the drawings.

DETAILED DESCRIPTION OF A PREFERRED EMBODIMENT

Figure 1:
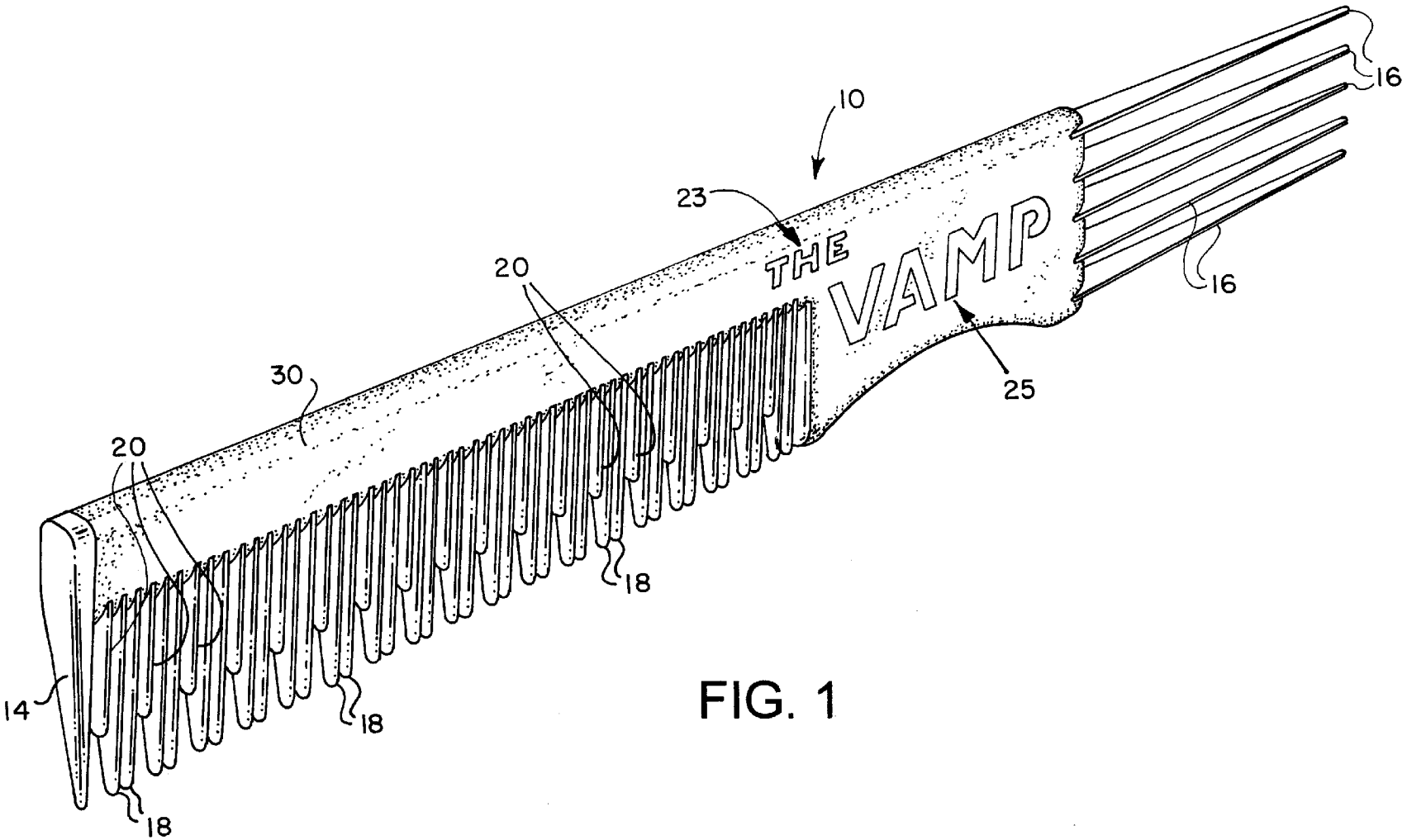
FIG. 1 is a perspective view of a hair styling comb in accordance with the invention.

In the description which follows like parts are marked throughout the specification and drawing with these same reference numerals, respectively. The drawing figures may not be to scale in all views in the interest of clarity.

Figure 2:
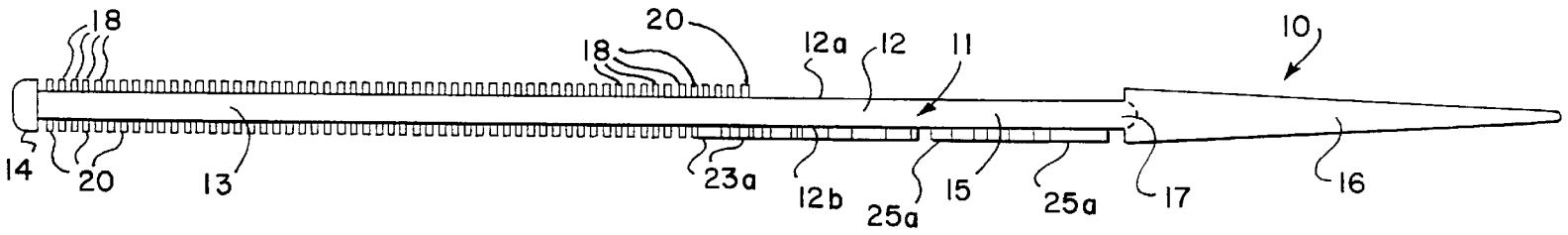
FIG. 2 is a top plan view of a core member for the comb shown in FIG. 1.
Figure 3:
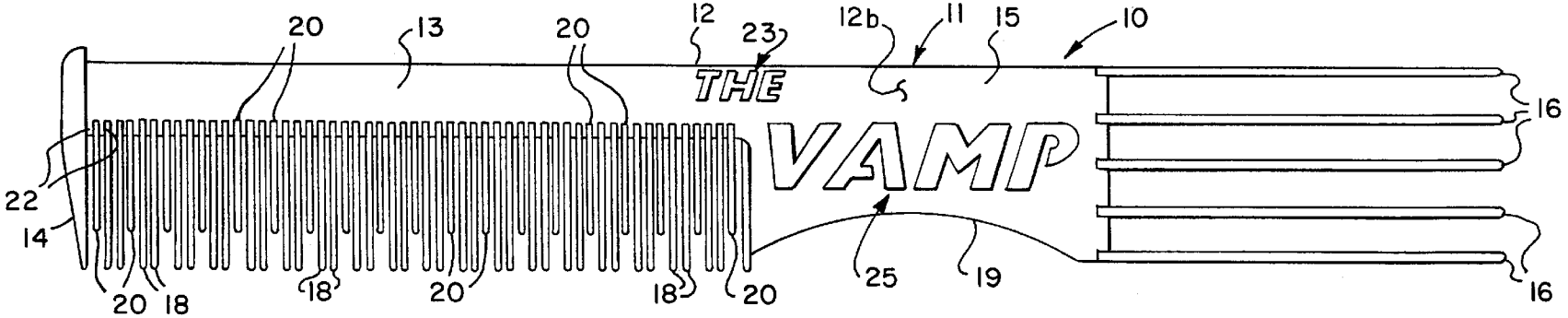
FIG. 3 is a side elevation of the core member shown in FIG. 2.
Figure 4:
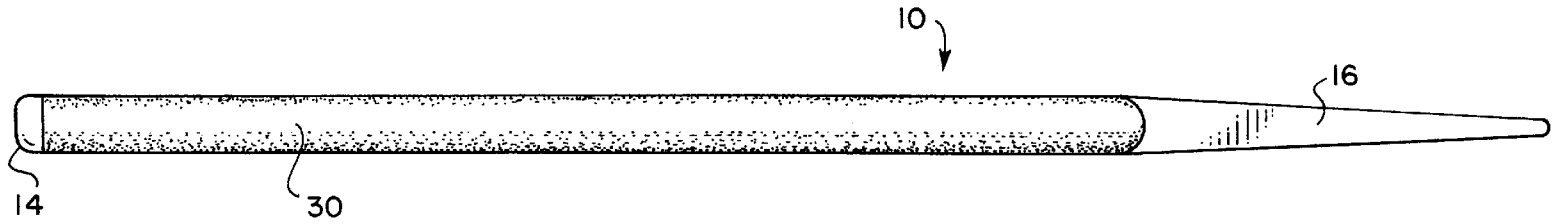
FIG. 4 is a top plan view of the comb shown in FIG. 1.
Figure 5:
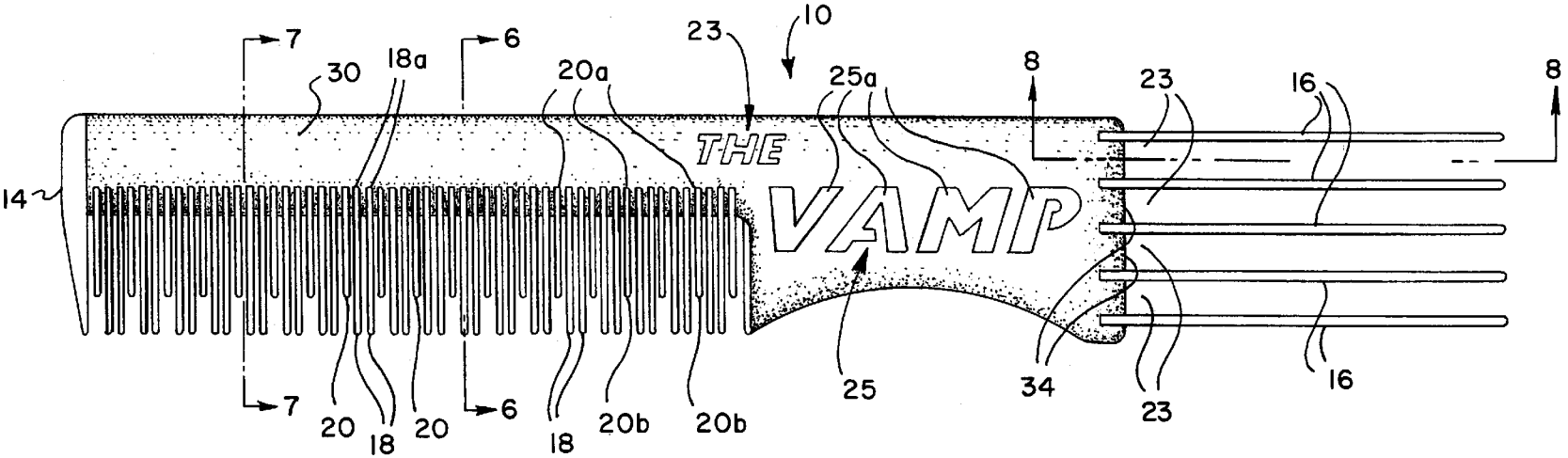
FIG. 5 is a side elevation of the comb shown in FIG. 1.

Referring to FIGS. 1 through 5, there is illustrated a hair styling comb in accordance with the invention and generally designated by the numeral 10. FIGS. 1, 4 and 5 illustrate the comb 10 in its finished state whereas FIGS. 2 and 3 illustrate a core member 11 of the comb 10 which includes a generally planar body part 12 having opposed, planar side surfaces 12*a* and 12*b* which extend between a combination integral end cap and tooth 14 and a set of laterally projecting spaced apart hair lifting and stroking teeth or prongs 16. The teeth 16 are integrally joined to the body part 12 at respective roots 17, see FIG. 2.

Figure 5A:
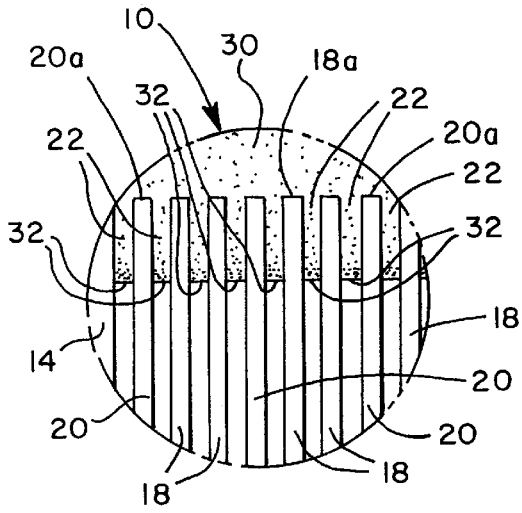
FIG. 5A is a detail view of a portion of FIG. 5 on a larger scale.

The comb 10 also includes spaced apart, parallel elongated styling or combing teeth 18 which are preferably arranged in pairs, as shown in FIG. 3, having disposed therebetween spaced apart secondary teasing teeth 20. Uniform spaces 22 are formed between each of the teeth 18 and 20 as indicated in FIGS. 2, 3 and 5A. The teeth 18 and 20 are integrally joined to an elongated spine 13 of the body part 12, FIGS. 2 and 3, extending between the end cap 14 and a hand grip 15 of the body part 12. The teeth 18 and 20 are preferably tapered from root portions 18*a* and 20*a* to distal ends 18*b* and 20*b*, respectively, see FIGS. 5, 5A, 6 and 7. The hand grip 15 may include a concave arcuate surface 19 extending between the styling teeth 18, 20 and the lifting teeth 16, as shown.

The core member 11 of the comb 10 described above and shown in FIGS. 2 and 3 is preferably molded of a suitable, relatively hard but somewhat resilient resin material, including but not limited to an acetal polymer, nylon or ABS terpolymer, for example. Other materials used for combs may also be used to form the core member 11 of the comb 10 including the teeth 16, 18 and 20. Suitable integrally molded indicia 23, 25 may be formed on at least one surface 12*b* as indicated in FIGS. 2 and 3.

Figure 6:
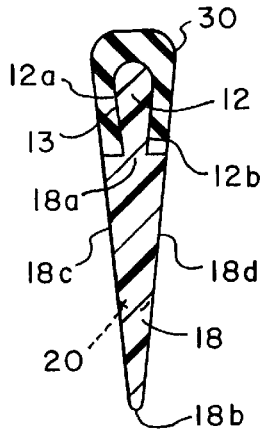
FIG. 6 is a section view taken along the line 6—6 of FIG. 5.
Figure 7:
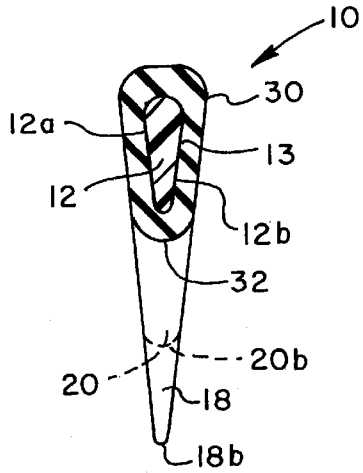
FIG. 7 is a section view taken along the line 7—7 of FIG. 5.
Figure 8:
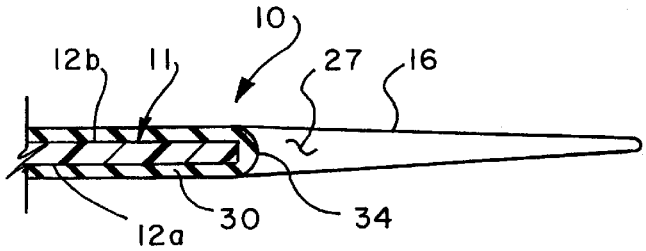
FIG. 8 is a section view taken along the line 8—8 of FIG. 5.

The core member 11 may be formed of one of the above referenced materials by injection molding to form an integral member. Typically, the materials used which are suitable for the core member 11 form a relatively hard low friction surface which is desirable for a major portion of the surfaces of the teeth 16, 18 and 20 but not for the surfaces between the base portions of the teeth 18 and 20, in particular, at their juncture with the body part 12. However, in accordance with the present invention a hair styling comb which includes several advantages is provided by applying a coating or overmolded layer of somewhat resilient material highly adherent to hair or otherwise having friction properties which create drag or adherence to hair when the hair is drawn between the teeth 18 and 20, in particular. As shown in FIGS. 1 and 4 through 8, the above-mentioned overmolded material layer is generally designated by the numeral 30 and preferably provides a complete covering of the body 12 except for the outer surface of the end cap 14 and the outer planar surfaces 23*a* and 25*a* of the indicia 23 and 25, which surfaces are generally parallel to the surface 12*b*, for example. However, the material layer 30 does not cover a major portion of the teeth 18 or 20 or the teeth or prongs 16 as shown in FIGS. 6, 7 and 8. The material layer 30 does, however, occupy the spaces 22 between the teeth 18 and 20 as well as the spaces 27, FIG. 8, between the teeth 16 at least to a predetermined extent.

As indicated in FIGS. 5A and 7, the material layer 30 preferably forms a continuous surface 32 between the teeth 18 and 20, as shown by way of example in FIG. 7. Moreover, a continuous surface 34 is also preferably formed by the material layer 30 between the teeth 16, as shown in FIG. 8. Accordingly, as hair is drawn between the teeth 18 and 20 during a styling operation, the hair strands will engage the surfaces 32 between each pair of teeth 18 or 18 and 20 to create frictional drag on the hair strands and facilitate the teasing or ratting operation. However, a major portion of each tooth 18 and 20 remains uncovered by the material layer 30 and functions in a normal manner to allow hair to flow between the teeth. As indicated by way of example in FIG. 6, the width of the comb teeth 16, 18 and 20 at their juncture with body part 12 may be greater than the thickness of the body part. The side surfaces 12*a* and 12*b* of the spine 13 may be configured to converge toward each other at the teeth 18, 20. In this way side edges 18*c* and 18*d* of the teeth 18 are essentially coplanar with the material layer 30, as shown in FIG. 6. The teeth 16, 18 and 20 are preferably tapered in the manner shown in FIGS. 6, 7 and 8.

A major advantage of molding the material layer 30 over the core member 11 of the comb 10 and between the teeth 16, 18 and 20 is that a uniform, dimensionally controlled material layer is provided which is superior to other known methods for applying adherent coatings or other hair styling structural features to hair styling combs.

The materials and surface finish thereon disclosed for the hair styling comb in U.S. Pat. No. 3,867,502 issued to C. A. Moody on Feb. 18, 1975 may be used in fabricating the comb of the present invention. The subject matter of U.S. Pat. No. 3,867,502 is incorporated herein by reference. Other materials, as mentioned above, are also suitable for the core member 11. Polyurethane may also be used for the overmolded material layer 30. The proportions of the overmolded surfaces 32 with respect to the overall length of the teeth 18 may be approximately the same as set forth in U.S. Pat. No. 3,867,502 and the length of the teeth 20 may be approximately 70% to 80% of the length of the teeth 18. The length of the teeth 16 may be approximately 250% to 300% of the length of the teeth 18. The coating or material layer 30 may be applied to the core member 11 of the comb 10 using a conventional injection molding apparatus by placing the core member in the mold and injection molding the material layer 30 thereover to completely cover the core member except for the portions of the teeth 16, 18 and 20 indicated and the end cap 14 as well as the outer planar surfaces 23*a* and 23*b* of the indicia 23 and 25 which are parallel to the surface 12*b*.

Those skilled in the art will appreciate that a comb in accordance with the present invention, including the exemplary embodiment 10 described above, offers several advances in the art of hair styling combs. The material layer 30 including the surfaces 32 and 34, in particular, provides the requisite adherent surfaces for teasing, ratting or back combing hair. Moreover, by overmolding substantially the entire body part 12 of the comb 10 with the material layer 30 the comb may be more easily handled by a person using the comb without a tendency for the comb to slip from the person's grasp. Also, when the comb 10 is residing on a smooth low friction surface, the adherence characteristics of the material layer 30 will minimize slippage of the comb along such a surface. Still further, the comb 10 tends to make less noise when placed or dropped onto a hard surface since it is quite likely that the first point of contact of the comb with such a surface will be on the major portion of the core member 11 that is covered by the resilient material layer 30.

Although a preferred embodiment of the invention has been described in detail herein those skilled in the art will appreciate that various substitutions and modifications may be made in the hair styling comb without departing from the scope and spirit of the appended claims.

What is claimed is:

1. A hair styling comb comprising:

a molded plastic core member characterized by a body part adapted to be grasped by a person's hand for handling said comb, an elongated spine portion integral with said body part and extending from said body part, and a first set of spaced apart, substantially parallel teeth extending from said spine portion; and a layer of moldable material adherent to human hair disposed in spaces formed between said teeth and formed as a layer of material covering a major portion of said core member including said spine portion and said body part, said material layer having opposed surfaces extending generally parallel to opposed generally planar surfaces of said spine portion and said body part, said opposed surfaces of said material layer being substantially coplanar with opposed side edges of said teeth at base portions of said teeth, respectively, and said material layer is applied to said core member by molding said material layer to be disposed in said spaces between said teeth, to extend over said body part and to extend over said spine portion to form a continuous integral material layer on said core member to aid in grasping and holding said comb, and said material layer is formed of a material selected from a group consisting of latex rubber, neoprene, silicone resin and polyurethane.

2. The comb set forth in claim 1 including:

a second set of teeth formed integral with and extending from said body part in a direction substantially normal to the direction of extension of said first set of teeth.

3. The comb set forth in claim 2 wherein:

said material layer extends between adjacent ones of said second set of teeth at base portions thereof connected to said body part, respectively.

4. A hair styling comb comprising:

an integral core member characterized by a body part adapted to be grasped by a person's hand for handling said comb, an elongated spine portion integral with said body part and extending from said body part, a first set of spaced apart, substantially parallel teeth extending from said spine portion, and a second set of teeth extending from said body part in a direction substantially normal to the direction of extension of said first set of teeth; and a layer of moldable material adherent to human hair disposed in spaces formed between said teeth and formed as a layer of material covering a major portion of said core member including substantially all of said spine portion and said body part, respectively, said material layer having opposed surfaces extending generally parallel to opposed generally planar surfaces of said core member at said spine portion and said body part, said opposed surfaces of said material layer being substantially coplanar with opposed side edges of said teeth at base portions of said teeth, respectively, and said material layer is applied to said core member by molding said material layer over said body part and said spine portion to form a continuous integral material layer on said core member to aid in grasping and holding said comb by one of sa spine portion and said body part, and said material layer is formed of a material selected from a group consisting of latex rubber, neoprene, silicone resin and polyurethane.

5. A hair styling comb comprising:

a molded plastic core member characterized by a body portion having a region adapted to be grasped by a person's hand for handling said comb, an elongated spine portion integral with said body portion, and a first set of spaced apart, substantially parallel teeth extending from said spine portion;

a layer of moldable material adherent to human hair disposed in spaces formed between said teeth and formed as a layer of material covering a major portion of said core member including said spine portion and said body portion, said material layer having opposed surfaces extending generally parallel to opposed generally planar surfaces of said core member, said opposed surfaces of said material layer being substantially coplanar with opposed side edges of said teeth at base portions of said teeth, respectively, and said material layer is applied to said core member by molding said material layer over said body portion and said spine portion to form a continuous integral material layer on said core member, and said material layer is formed of a material selected from a group consisting of latex rubber, neoprene, silicone resin and polyurethane; and indicia molded integral with said core member and delimited by a surface substantially parallel to one of said opposed surfaces of said body portion and spaced from said one surface of said body portion, and said material layer is molded on said body portion around said indicia but without covering said surface of said indicia parallel to said one surface of said body portion.

* * * * *